US007896092B2

(12) United States Patent
Hernandez Reina

(10) Patent No.: US 7,896,092 B2
(45) Date of Patent: Mar. 1, 2011

(54) DEVICE TO EXTINGUISH A FIRE PRODUCED IN A BUILDING

(76) Inventor: José Antonio Hernandez Reina, Alicante (ES)

( * ) Notice: Subject to any disclaimer, the term of this patent is extended or adjusted under 35 U.S.C. 154(b) by 0 days.

(21) Appl. No.: 11/794,833

(22) PCT Filed: Dec. 16, 2005

(86) PCT No.: PCT/ES2005/000686

§ 371 (c)(1),
(2), (4) Date: Jul. 6, 2007

(87) PCT Pub. No.: WO2006/089977

PCT Pub. Date: Aug. 31, 2006

(65) Prior Publication Data

US 2008/0115947 A1 May 22, 2008

(30) Foreign Application Priority Data

Feb. 24, 2005 (ES) ..... 200500427
Feb. 24, 2005 (ES) ..... 200500427 U

(51) Int. Cl.
*A62C 8/00* (2006.01)
*A62C 37/10* (2006.01)
*F42B 12/46* (2006.01)

(52) U.S. Cl. ..... 169/28; 169/36; 169/60; 169/61; 102/367; 102/368; 102/369; 102/370

(58) Field of Classification Search ..... 169/28, 169/30, 36, 52–54, 56, 58, 60, 61, 70, 72, 169/84; 102/202.5, 367–370, 382, 487, 488, 102/502

See application file for complete search history.

(56) References Cited

U.S. PATENT DOCUMENTS

| | | | | |
|---|---|---|---|---|
| 3,833,064 | A * | 9/1974 | Ranney, Jr. | 169/52 |
| 4,285,403 | A * | 8/1981 | Poland | 169/28 |
| 4,964,469 | A * | 10/1990 | Smith | 169/28 |
| 6,082,265 | A | 7/2000 | Sakamoto et al. | |
| 6,470,805 | B1 * | 10/2002 | Woodall et al. | 102/370 |
| 6,725,941 | B2 * | 4/2004 | Edwards et al. | 169/47 |
| 7,089,862 | B1 * | 8/2006 | Vasquez | 102/369 |

(Continued)

FOREIGN PATENT DOCUMENTS

CN 1476911 A 2/2004

(Continued)

OTHER PUBLICATIONS

International Search Report.

*Primary Examiner*—Darren W Gorman
(74) *Attorney, Agent, or Firm*—Collard & Roe, P.C.

(57) ABSTRACT

Device to extinguish a fire produced in a building, characterized by having a bomb comprising a hollow body whose inner part carries a load of a fire-retarding component and an actuator that, when it hits the surface of the building, activates a detonator that makes the charge explode, scattering the fire-retarding component over the whole surface area of the radius of action, the detonator and explosive charge contained inside a receptacle and the detonator being connected by means of an electrical wire to one or various actuators installed on the surface of the body of the bomb.

3 Claims, 1 Drawing Sheet

U.S. PATENT DOCUMENTS

| | | | | |
|---|---|---|---|---|
| 2003/0006046 | A1* | 1/2003 | Kaimart | 169/26 |
| 2006/0162941 | A1* | 7/2006 | Sridharan et al. | 169/53 |

FOREIGN PATENT DOCUMENTS

| | | | |
|---|---|---|---|
| EP | 320554 | A | 6/1989 |
| ES | 2010012 | A | 10/1989 |
| ES | 2029638 | A | 8/1992 |
| ES | 2122946 | A | 12/1998 |
| RU | 2193906 | A | 12/2002 |
| WO | WO 9705446 | | 2/1997 |

* cited by examiner

DEVICE TO EXTINGUISH A FIRE PRODUCED IN A BUILDING

CROSS REFERENCE TO RELATED APPLICATIONS

Applicant claims priority under 35 U.S.C. §119 of Spanish Application No. U200500427 filed Feb. 24, 2005 and Spanish Application No. P200500427 filed Feb. 24, 2005. Applicant also claims priority under 35 U.S.C. §365 of PCT/ES2005/000686 filed Dec. 16, 2005. The international application under PCT article 21(2) was not published in English.

OBJECT OF THE INVENTION

The present invention refers to a device to extinguish a fire produced in a building.

BACKGROUND OF THE INVENTION

At present, there are important problems at the time of extinguishing a fire in a building, especially if it is of considerable height, since technical means are unable to smother flames at a certain height.

In this way, for example, water pressure is insufficient to reach a specific height, facilitating the spread of flames to heights above, turning out to be practically impossible to extinguish the fire, and its structure, generally steel, suffers sufficiently to cause the general collapse of the building.

It is well-known that when this circumstance takes place, furniture and files are destroyed, only the skeleton or structure of the building remaining at the mercy of the flames.

The problems that this type of fires produce are not only material, but, in general, are accompanied by human losses.

To solve these problems, the invented device, easy to embody and also easily transportable to be launched from a helicopter or even with a gun in the missile-shape format, has been designed.

DESCRIPTION OF THE INVENTION

The invented device comprises a preferably spheroid-shaped body, enclosed within which is a space containing an explosive charge with a detonator, which causes the above-mentioned charge, connected by means of electrical wires to an actuator, to explode.

The actuators are distributed around the surface of the spheroid body, so that, on any of the actuators hitting a part of the building, the explosion of the body, that constitutes a bomb, is produced.

The fireproof material used to extinguish the fire is contained inside the body.

As soon as the spheroid-shaped body strikes the building, the explosion is produced and its disintegration or breakup causes fire-retarding material contained within to fall in the area, smothering the flames.

Among others, this fire-retarding material may be carbon dioxide.

A variation in the embodiment of the invention is when the body has a missile shape, with a timer at the corresponding end of its nosecone or remote control actuator connected to the detonator located at the very opposite area, which activates the explosive charge that breaks the body of the missile containing the fire-retarding material.

In this embodiment, due to the shape of the body, it may be launched from a distance and inserted through a small area of the building on fire, for example, through a window, and also has the great advantage of being able to explode with time delay, that is to say, controlled.

With the invented device, it is possible to immediately extinguish or considerably reduce the flames of a building on fire.

These bombs, when they are missile-shaped, may also be launched from a distance to enable firemen to act at a much greater safety distance.

Besides, with this device, floors of the building that are inaccessible to water hoses on being too high, may be reached.

In short, with the invented device, whether the bomb is spheroid or missile-shaped, it may be launched either from a helicopter or with a gun from a distance and conveniently and safely hit the corresponding areas of the building and thus easily smother the fire that the building is suffering.

The guns may be installed in ground vehicles to accurately launch the bombs and hit the affected zone or zones of the building.

These guns, when they are small in size, may be carried by people and used to launch the bombs with the corresponding fire-retarding product.

DESCRIPTION OF A PRACTICAL EXAMPLE OF EMBODIMENT OF THE INVENTION

Device 1 of the invention used to extinguish the fire produced in a building comprises a bomb with a hollow body 2 that may be of any type of material providing that it meets the characteristics of use for the device itself.

Figure 1:
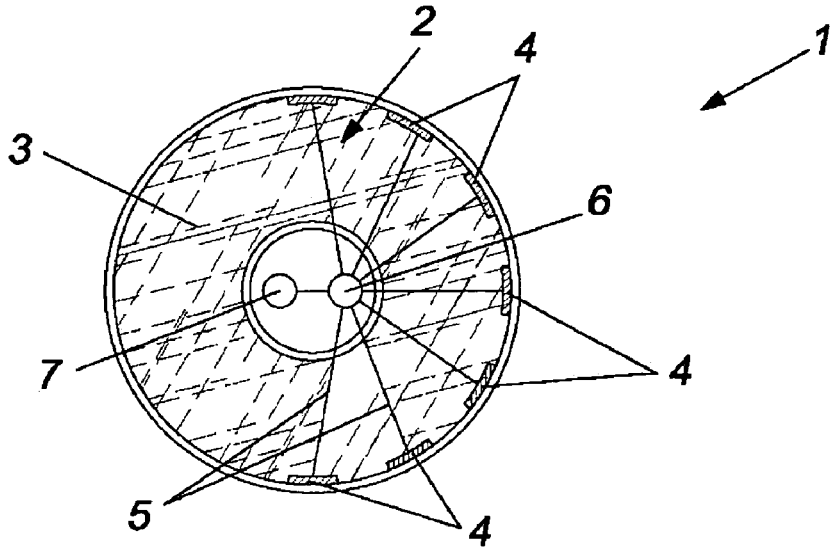
FIG. 1 shows a lateral view of the bomb that carries the fire-retarding material inside, according to the version.
Figure 2:
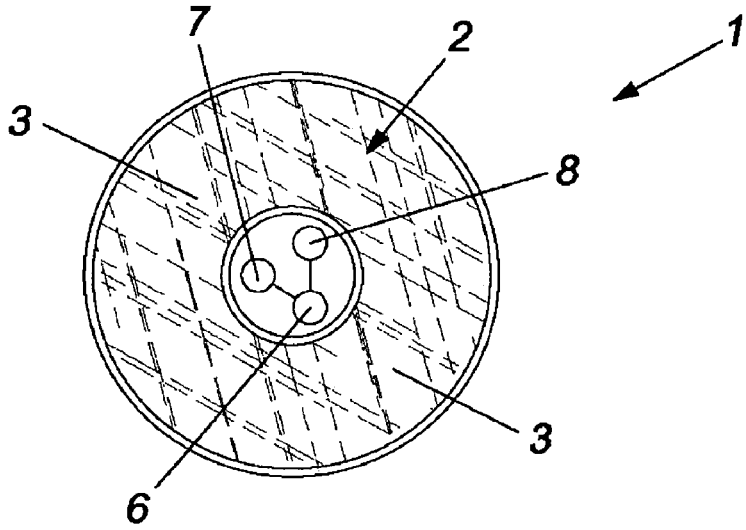
FIG. 2 shows a variation of the bomb in FIG. 1.

The hollow body 2, which houses the fire-retarding material 3, may be spherical, in which case, FIG. 1, it has actuators 4 on the surface, that, when they hit the surface area of the building, by means of electrical wires 5, activate a detonator 6 which causes the charge 7 carried inside the hollow body to explode.

When the explosion is produced, the fire-retarding component 3 is scattered over the whole surface area of the radius of action.

When the bomb has time-delay, it has a timer 8.

Figure 3:
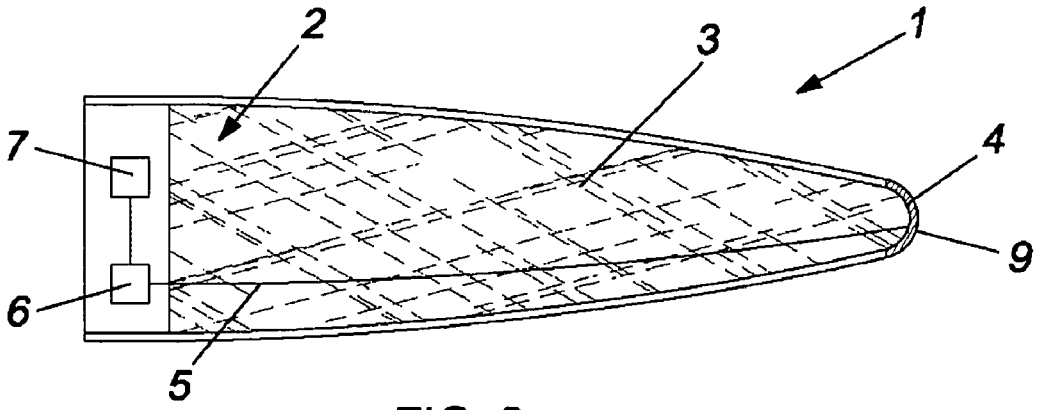
FIG. 3 shows a missile-shaped bomb according to the invention.

The bomb may be missile-shaped, FIG. 3, in which case, it has the actuator 4 on the outside of the nosecone 9, that, when it hits the surface area of the building, by means of the electrical conductor 5, activates the detonator 6 which causes the explosive charge 7 carried inside the hollow body of the missile, to explode.

When the explosion is produced, the fire-retarding component 3 is scattered over the whole surface area of the missile's radius of action.

Having sufficiently described the nature of the invention, as well as the way to embody it in practice, it must be emphasized that the previously indicated layouts, represented in the attached drawings, may be modified in detail as long as they do not alter the fundamental principle.

The invention claimed is:

1. A device to extinguish a fire produced in a building, the device comprising a spherical hollow body which encloses:

a load of a fire-retarding component;

an explosive charge which explodes upon activation of a detonator for scattering the fire-retarding component;

a plurality of actuators disposed on an inner surface of the spherical hollow body, the plurality of actuators being distributed over a portion of a circumference of the spherical hollow body comprising over one half of a total circumference of the spherical hollow body and connected to the detonator by at least one electrical wire, the actuators actuated by striking the building, wherein at least one of the plurality of actuators activates the detonator upon striking the building and the actuators are adapted to activate the detonator when any of the actuators hits a part of the building; and a timer connected to the detonator for allowing an explosion of the explosive charge to be time-delayed.

2. The device according to claim 1, wherein the fire-retarding component comprises carbon dioxide.

3. The device according to claim 1, wherein the device is suitable for being launched from a helicopter.

* * * * *